United States Patent [19]

Arisland

[11] Patent Number: 4,483,469

[45] Date of Patent: Nov. 20, 1984

[54] CONVERTIBLE CARRIER BAG

[76] Inventor: Björg Arisland, 102 Dorchester Blvd., St. Catharines, Ontario L2M 6V2, Canada

[21] Appl. No.: 596,080

[22] Filed: Apr. 4, 1984

Related U.S. Application Data

[63] Continuation of Ser. No. 436,737, Oct. 26, 1982, abandoned, which is a continuation of Ser. No. 202,745, Oct. 31, 1980, abandoned, which is a continuation-in-part of Ser. No. 177,366, Aug. 11, 1980, abandoned.

[30] Foreign Application Priority Data

Aug. 15, 1979 [NO] Norway ..... 792657

[51] Int. Cl.[3] ..... A41D 1/04; A45C 9/00

[52] U.S. Cl. ..... 224/151; 2/102; 190/107; 224/204; 294/141

[58] Field of Search ..... 2/94, 102; 224/15, 153, 224/204, 209, 214, 215; 190/107, 110, 117; 294/141

[56] References Cited

U.S. PATENT DOCUMENTS

| | | | |
|---|---|---|---|
| 340,339 | 4/1886 | Marshall | 224/151 |
| 554,843 | 2/1896 | Smoot | 224/151 |
| 1,475,072 | 11/1923 | Langerman | 2/102 |
| 1,797,359 | 3/1931 | Meyers | 2/94 X |
| 1,879,341 | 9/1932 | Lapham | 2/102 |
| 2,475,914 | 7/1949 | Peterson | 224/204 |
| 2,485,442 | 10/1949 | Halliday | 2/94 |
| 2,620,479 | 12/1952 | Buck | 2/102 X |
| 2,870,448 | 1/1959 | Rosenthal | 2/102 X |
| 3,085,250 | 4/1963 | Finlay | 2/94 X |
| 3,105,241 | 10/1963 | Allen | 2/102 X |
| 3,786,972 | 1/1974 | Alley | 224/31 |
| 3,830,348 | 8/1974 | Ohyama | 190/52 X |
| 3,848,267 | 11/1974 | De Spain | 224/151 X |
| 4,106,121 | 8/1978 | Belson | 2/102 |
| 4,213,204 | 7/1980 | Donlon et al. | 2/94 |

*Primary Examiner*—Stephen Marcus
*Assistant Examiner*—Robert Petrik
*Attorney, Agent, or Firm*—Fetherstonhaugh & Co.

[57] ABSTRACT

A carrier bag which is convertible between a body support configuration and a hand support configuration consists of a vest and two purse segments. The two purse segments are connected one at the lower edge of each front panel of the vest. A zip fastener as provided for connecting the pouch segments to one another in a face-to-face relationship to form a garment storage compartment between which is proportioned to accommodate the vest. The pouch is supported in close proximity to the torso of the wearer when the garment is worn and the garment may be stored within the garment storage compartment when the segments of the pouch are in the face-to-face relationship so that it may be carried as a handbag.

3 Claims, 5 Drawing Figures

CONVERTIBLE CARRIER BAG

RELATED APPLICATIONS

This application is a continuation of application Ser. No. 436,737 filed Oct. 26, 1982, now abandoned which is a continuation of application Ser. No. 202,745, filed Oct. 31, 1980, now abandoned, which is a continuation-in-part of application Ser. No. 177,366, filed Aug. 11, 1980, now abandoned.

FIELD OF INVENTION

This invention relates to convertible carrier bags. In particular, this invention relates to a carrier bag which may be converted from a handbag configuration to a garment supported configuration.

PRIOR ART

Money belts or the like have been used for many years for carrying valuables on the person to guard against theft and robbery. Money belts have the advantage that they can be hidden beneath the clothing of the wearer so as to be inconspicuous and they can be securely fastened so that they cannot be removed without the cooperation of the wearer. The conventional money belt does, however, have only limited use and it is not conveniently constructed for everyday use by shoppers or the like.

Handbags are a preferred form of carrier bag used, particularly by women, for carrying numerous small valuable items such as cash, credit cards, passports, personal identification papers, cosmetics and jewellery and the like. Handbags are, however, very easily stolen by purse snatchers because they can be wrenched from the hand of a robbery victim with relative ease. This is particularly true where the victim is elderly.

The carrier bag of the present invention overcomes the difficulties described above in that it can be readily converted to a garment supported configuration in which it has many of the advantages of a money belt and to a handbag configuration in which it may be used with the facility of a handbag.

SUMMARY OF INVENTION

According to one aspect of the present invention, a carrier bag which is convertible between a garment supported configuration and a hand supported configuration comprises a pouch having a storage compartment, a vest adapted to fit a human torso, said vest being secured to said pouch such that the pouch is supported by the vest in close proximity to the torso of the wearer in use and being adapted to fit within the storage compartment so that the pouch may assume its hand supported configuration.

According to yet another aspect of the present invention, a carrier bag which is convertible between a garment supported configuration and a hand supported configuration comprises a pair of pouches, means for releasably securing said pouches in a face-to-face relationship defining a vest storage compartment therebetween, a vent adapted to fit a human torso, said vest being secured to said pouches such that each pouch may be suspended from the vest in close proximity to the torso of the wearer in use when said means for releasably securing the pouches is released, said vest being adapted to fit within said vest storage compartment so that the pouches may assume a handbag configuration when in said face-to-face relationship.

PREFERRED EMBODIMENTS

The invention will be more clearly understood after reference to the following detailed specification read in conjunction with the drawings, wherein FIG. 1 is a pictorial front view of the carrier bag in a garment support configuration;

Figure 1:
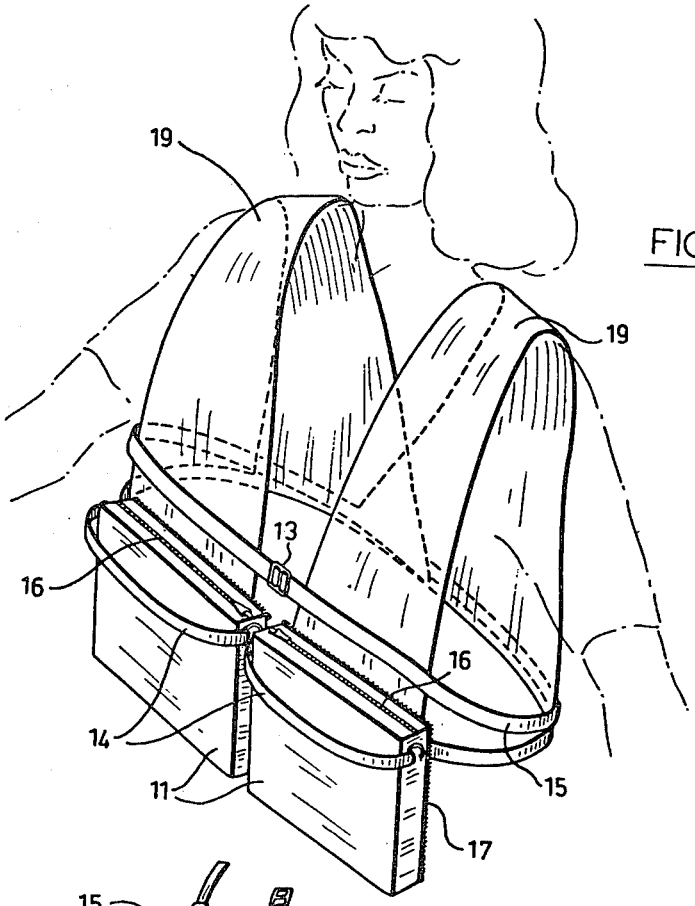
Figure 3:
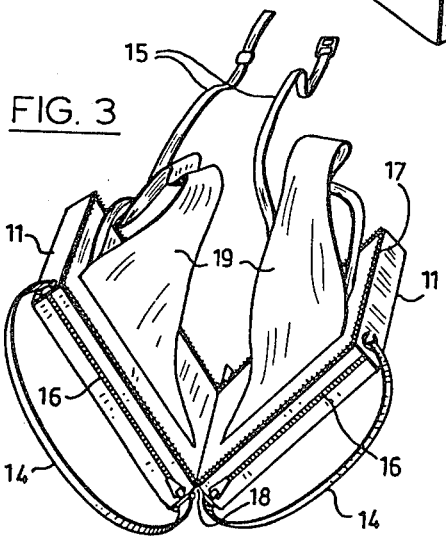
FIG. 3 is a view of the carrier bag illustrating the manner in which the vest portion is housed in a vest storage compartment located between two pouch sections.
Figure 2:
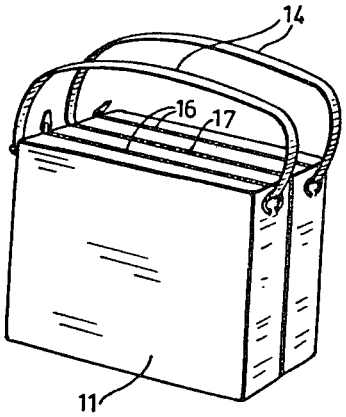
FIG. 2 is a pictorial view of the carrier bag in a hand support configuration.
Figure 4:
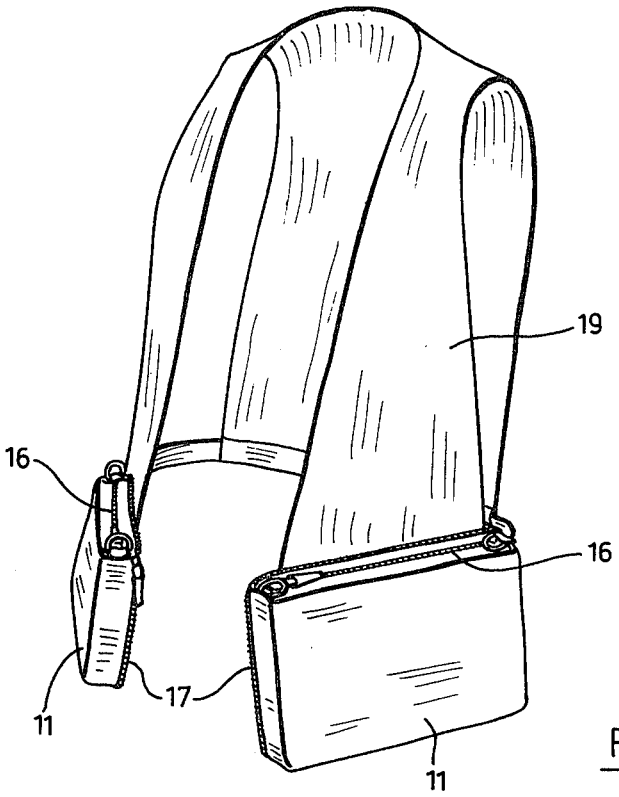
FIG. 4 is a pictorial view of a carrier bag constructed in accordance with a further embodiment.
Figure 5:
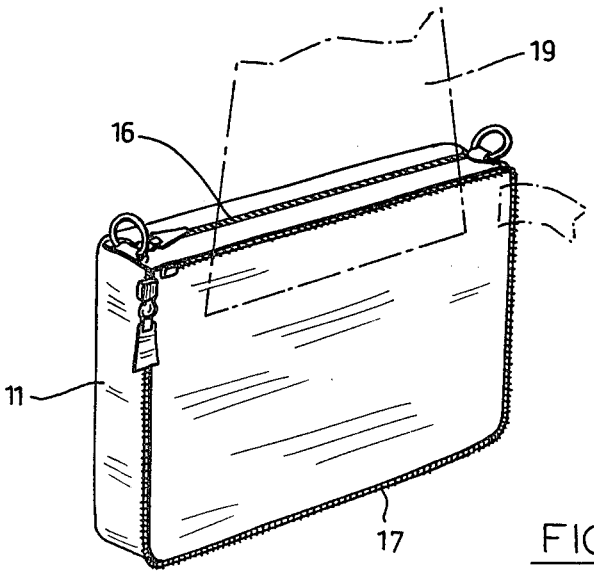
FIG. 5 is a view of the inner face of one pouch of the embodiment illustrated in FIG. 4.

With reference to the drawings, reference numeral 11 refers generally to two generally rectangular shaped pouches which are preferably constructed from soft flexible material such as leather, plastic or the like and have a configuration of a conventional handbag with the thickness of each pouch being about half the thickness of the required handbag configuration. The two pouch sections 11 are preferably connected to one another along juxtaposed edges by means of a flexible connector hinge 18. The hinge 18 maybe releasable so that the two pouches can be disconnected or it may be a fabric hinge which permanently secures the juxtaposed edges along the line 18. By reason of the flexible connection, the pouches 11 may be moved between the position shown in FIG. 1 in which they are arranged in side-by-side relationship in the position shown in FIG. 2 in which they are arranged in a face-to-face relationship. Each of the storage compartments of the pouches 11 is closed by means of a zip fastener 16 and a further zip fastener 17 extends around the periphery of the free edges of the pouches 11 so as to be operable to retain the pouches in the handbag configuration shown in FIG. 2. A vest storage compartment is formed between the pouches 11 when they are located in the handbag configuration illustrated in FIG. 2. The vest consists of a pair of shoulder straps 19 and fastening straps 15. The shoulder straps 19 are secured at one edge to the pouches 11 inwardly of the vest storage compartment. Shoulder straps 19 are proportioned so that when the carrier bag is in the garment support configuration, the shoulder straps support the pouches 11 against the abdomen of the wearer so that they are relatively inconspicuous and are inobtrusive in that they do not restrict body movement. The tie straps 15 extend from opposite ends of each pouch to the back edge of the adjacent shoulder strap and thereafter extend around the front of the wearer to be connected by means of a buckle fastener 13 or the like. Carrying handles 14 are secured to the pouches 11 for use when the carrier bag is in the handbag configuration as illustrated in FIG. 2.

From the foregoing it will be apparent that when the carrier bag is to be used in a handbag configuration, the vest including the shoulder straps 19 and fastening straps 15 are folded into a compact configuration and stored within the storage compartment formed between the two pouch sections 11. The bag is retained in the handbag configuration by operation of the zip fastener 17. To convert from the handbag configuration to the garment support configuration, the zip fastener 17 is released and the vest is removed from its storage compartment and fitted around the wearer as shown in FIG. 1.

Various modifications of the present invention will be apparent to those skilled in the art without departing from the scope of the invention. For example, a pocket may be provided on the inner surface of each pouch so that the shoulder straps 19 and securing straps 15 may be securely retained within the vest storage compartment. Furthermore, the pouch may be formed as a single pouch unit with the entire vest being located within a storage compartment of the unitary pouch. Similarly, the carrier bag may be made from three or more pouches with the compartment for storing the vest being located in one or in each pouch.

It will also be apparent that the zip fasteners 16 and 17 may be replaced by any other convenient fastening mechanism. Furthermore, the zip fastener 17 may extend around the entire periphery of each pouch so that it forms the releasable hinge 18 along the peripheral edges as aforesaid.

What I claim is:

1. A carrier bag which is convertible between a garment supported configuration and a hand supported configuration comprising:

(a) a pair of pouches, (b) means for releasably securing said pouches in a face-to-face relationship defining a vest storage compartment therebetween, (c) a vest adapted to fit a human torso, said vest comprising a pair of shoulder straps, each having one end secured to one of said pouches, and having a sufficient extent to extend upwardly therefrom over the shoulders of the wearer, and means for securing the other ends of the shoulder straps in a position to releasably retain the shoulder straps on the wearer whereby each pouch may be suspended from the vest in close proximity to the torso of the wearer in use when said means for releasably securing said pouches is released, said vest being adapted to fit within said vest storage compartment so that the pouches may assume a handbag configuration when in said face-to-face relationship, said shoulder straps each having a front end and a back end, the front end of each strap being secured one to each pouch, said means for securing the other ends of said shoulder straps comprising tie straps connected to the back end of the shoulder straps and having a sufficient length to extend around the wearer to be releasably connected in front of the wearer.

2. A carrier bag which is convertible between a body supporting configuration and a hand-held configuration comprising:

(a) a front opening vest having a pair of front panels arranged one on either side of said front opening, each front panel having a lower edge portion, the vest being of a size such that each front panel is proportioned to locate its lower edge portion at about the waist of the wearer in use, (b) a flexible pouch having two pouch segments which are separable from one another, each segment having a storage compartment formed therein, (c) means for releasably securing said pouch segments in a face-to-face relationship to form a vest storage compartment therebetween, said vest storage compartment being proportioned to accommodate said vest, said vest storage compartment having a pair of inner walls one of which is a wall of one of said pouch segments and the other of which is a wall of the other of said pouch segments, (d) said lower edge portion of said front panels being connected one to one inner wall of one pouch segment and one to the inner wall of the other pouch segment, such that said pouch segments will depend from the lower edge portions of the vest when worn so as to locate the pouch segments at the waist of the wearer, and the vest may be stored within said vest storage compartment when said pouch segments are secured in said face-to-face relationship forming said vest storage compartment.

3. A carrier bag as claimed in claim 2 wherein said pouch segments have oppositely disposed side edges when in said garment configuration and means at said oppositely disposed side edges for securing said pouch segments to one another to close the front opening of the vest.

* * * * *